United States Patent [19]

Forney, Jr.

[11] Patent Number: 4,540,231

[45] Date of Patent: Sep. 10, 1985

[54] CONNECTOR FOR SEMIRIGID COAXIAL CABLE

[75] Inventor: Edgar W. Forney, Jr., Harrisburg, Pa.

[73] Assignee: AMP, Harrisburg, Pa.

[21] Appl. No.: 532,870

[22] Filed: Sep. 16, 1983

Related U.S. Application Data

[63] Continuation-in-part of Ser. No. 308,760, Oct. 5, 1981.

[51] Int. Cl.[3] ..... H01R 4/00

[52] U.S. Cl. ..... 339/94 C; 339/95 R; 339/177 R; 339/89 C

[58] Field of Search ..... 339/177, 94, 60

[56] References Cited

U.S. PATENT DOCUMENTS

| | | | |
|---|---|---|---|
| 2,549,647 | 4/1951 | Turenne | 339/177 R |
| 3,448,430 | 6/1969 | Kelly | 339/143 |
| 3,475,545 | 10/1969 | Stark et al. | 174/88 |
| 3,533,051 | 10/1970 | Ziegler, Jr. | 339/177 |
| 3,537,065 | 10/1970 | Winston | 339/177 |
| 3,544,705 | 12/1970 | Winston | 174/75 |
| 3,564,487 | 2/1971 | Upstone et al. | 339/258 |
| 3,778,535 | 12/1973 | Forney, Jr. | 174/88 C |
| 3,836,700 | 9/1974 | Neimeyer | 174/89 |
| 3,879,102 | 4/1975 | Horak | 339/143 R |
| 3,976,352 | 7/1976 | Dorrell et al. | 339/94 M |
| 4,408,821 | 10/1983 | Forney, Jr. | 339/177 R |
| 4,452,503 | 6/1984 | Forney, Jr. | 339/177 R |

FOREIGN PATENT DOCUMENTS

| | | |
|---|---|---|
| 1117687 | 11/1961 | Fed. Rep. of Germany . |
| 2234680 | 6/1974 | France . |

*Primary Examiner*—Gil Weidenfeld
*Assistant Examiner*—David L. Pirlot

[57] ABSTRACT

An electrical connector is disclosed for terminating semirigid coaxial cable, and comprises a grip ring having a continuous rearward end with multiple spline fingers extending forwardly therefrom and grooves on its inner surface, and a bored tubular shell member having a contoured internal diameter to accept the cable and the grip ring and grooves having an adhesive therealong extending along an outer part of the bore of the shell member. The cable is drawn through the grip ring and the shell member, and as the grip ring is press inserted into a rearward end of the shell member, the spline fingers resiliently deflect inwardly along the shell member contour, and embed into the outer semirigid cable sheath to establish electrical contact therewith and the grooved bore scores the outside surface of the grip ring during its movement into engagement with the cable sheath which causes the grooves of the grip ring to score the cable sheath, thereby providing antitorque connection therebetween. The adhesive extends along the engaging surfaces of the shell member and grip ring thereby sealing the connection and increasing the torque and tensile resistance thereof.

14 Claims, 9 Drawing Figures

CONNECTOR FOR SEMIRIGID COAXIAL CABLE

CROSS REFERENCE TO RELATED APPLICATION

This application is a Continuation-in-Part application of U.S. patent application Ser. No. 308,760 filed Oct. 5, 1981.

FIELD OF THE INVENTION

This invention relates to connector terminations for semirigid coaxial cable.

BACKGROUND OF THE INVENTION

The electronic industry utilizes semirigid coaxial cable in high performance RF and microwave applications. Use of such cables, however, has been limited because of the difficulty in achieving cable end termination. The solid, semirigid sheath of the coaxial cable, usually made of copper, makes it difficult to establish connectorized contact wherewith without degrading electrical performance at the junction. Where there are effective connectors available within the industry for this purpose, such connectors are generally expensive to produce, of multi-piece design, and employ costly labor intensive procedures to achieve cable end termination. One state-of-the-art procedure consists of pre-knurling the coaxial cable sheath, and subsequently crimping a copper connector sleeve thereto. While this approach achieves effective results, pre-knurling requires time, and inherently involves considerable variability due to sheath harness variation, cable diameter variation, and metal build-up on the knurling tool. Another procedure for making connectorized contact with the outer cable sheath is by way of solder; however, soldering also entails shortcomings due to the excessive time required to effect a termination, and the inherent necessity of controlling the narrow temperature range required to effect a good joint to semirigid cable. Too low a temperature will form a weak "cold" solder joint; too high a temperature will cause excessive expansion and protrusion of the cable dielectric at the mating interfaces.

SUMMARY OF THE INVENTION

The present invention comprises a connector plug for terminating semirigid coaxial cable. The plug includes a grip ring having a solid continuous rearward end with grooves on its inside surface, and having multiple spline fingers extending forwardly therefrom; a tubular shell nember having a bore of contoured internal diameter to accept the cable and the grip ring; external coupling means secured to the shell member; and forward gasket means for sealing the forward plug interface. The cable is drawn through the grip ring and the shell member, and as the grip ring is press inserted into a rearward end of the bored shell member, the spline fingers resiliently deflect inwardly along the contour of the shell bore to embed into the outer semirigid sheath of the cable. Internal longitudinal grooves are integrally provided within the inside surface of the rearward portion of the shell member which embed into the solid area of the grip ring and the grooves of the grip ring score the cable sheath to resist relative rotational motion between the grip ring and the shell member. A chemical adhesive is coated onto the internal longitudinal grooves on the inside surface of the rearward portion of the shell member and, as the grip ring moves relative to the shell member, shearing action ruptures the film of chemical adhesive promoting flow thereof which fills the voids between the engaging surfaces of the grip ring and shell member as well as being carried by the spline fingers and thereby being disposed between the inside surface of the shell member along which the spline fingers are disposed and the spline fingers and between the spline fingers in engagement with the cable sheath whereby the cured adhesive seals the connection and increases the torque and tensile of the connection.

Accordingly, it is an object of the present invention to provide a connector for achieving consistent mechanical and electrical termination of semirigid coaxial cable.

A further object of the present invention is to provide a connector for semirigid coaxial cable having integral sealing means.

A still further object of the present invention is to provide a connector for semirigid coaxial cable which is capable of field assembly.

A still further object of the present invention is to provide a connector for semirigid coaxial cable having integral retention means for controlling relative movement of connector parts.

An additional object of the present invention is the provision of a connector for semirigid coaxial cable that effects a seal between the engaging parts which also increases the torque and tensile of the connection.

Yet a further object of the present invention is to provide a connector for semirigid coaxial cable which is readily and economically produced, and readily assembled.

These and other objects, which will be apparent to one skilled in the art, are achieved by a preferred embodiment which is described in detail below, and which is illustrated in the accompanying drawings.

DETAILED DESCRIPTION OF THE PREFERRED EMBODIMENTS

Figure 1:
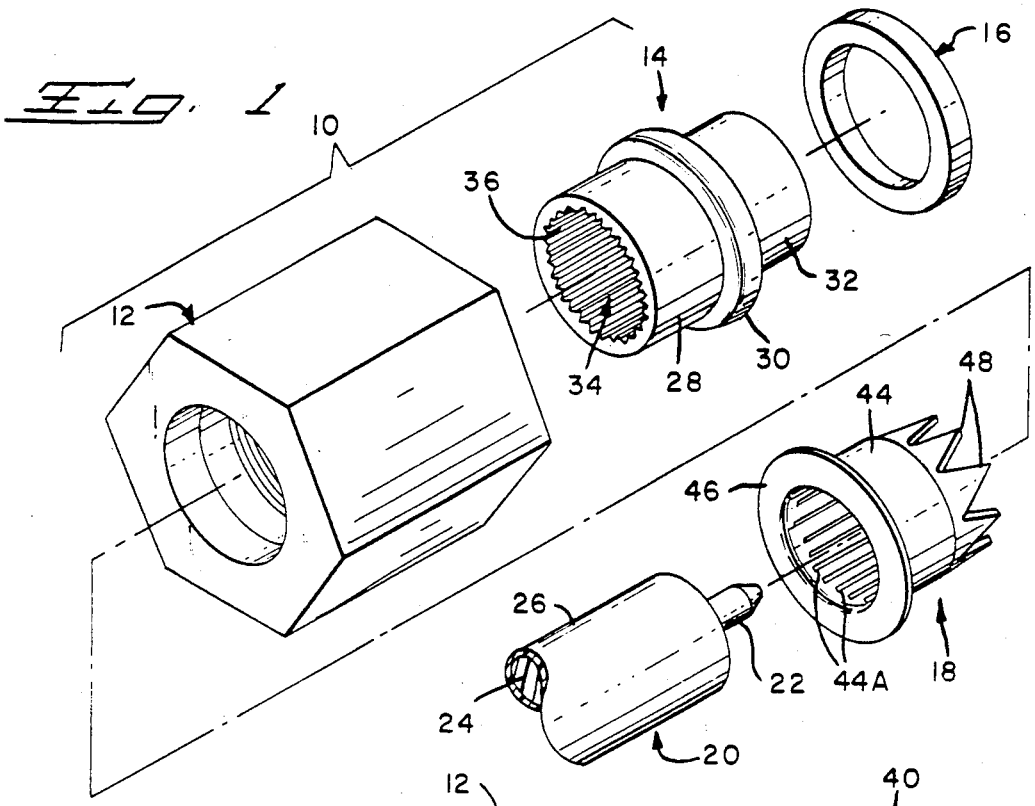
FIG. 1 is an exploded perspective view of the subject connector plug prior to assembly.
Figure 2:
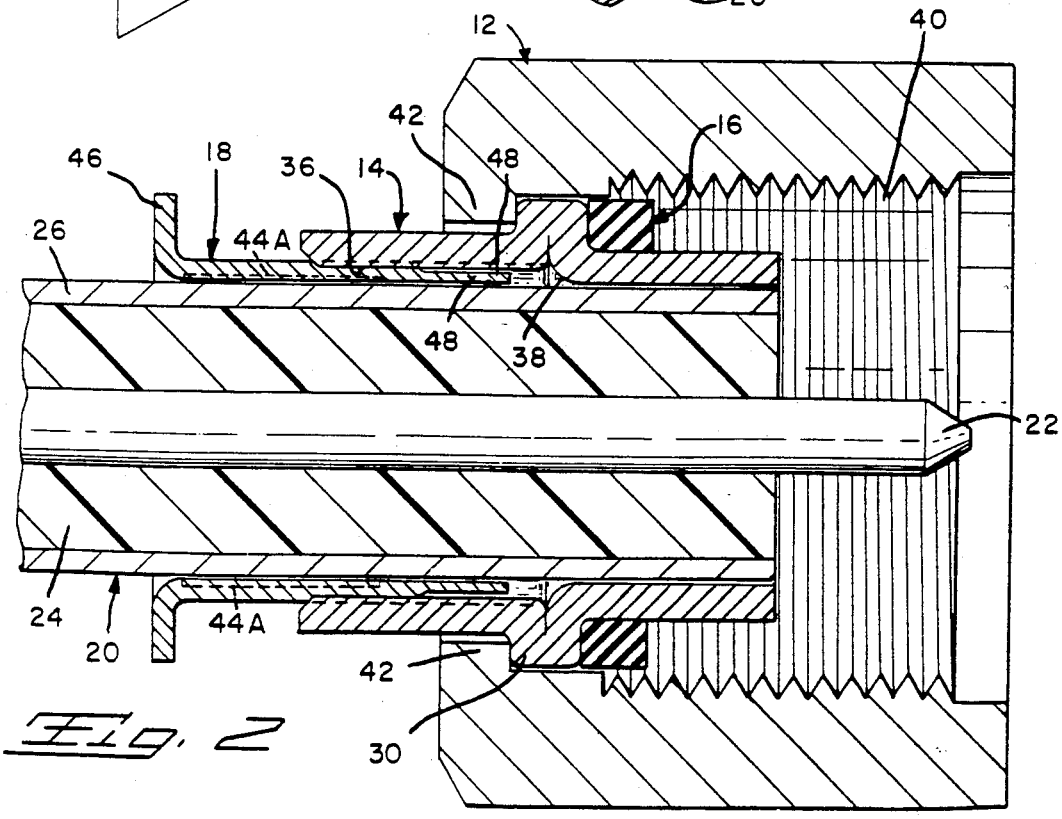
FIG. 2 is a side elevation view, taken partially in section, of the subject connector plug with the coaxial cable properly positioned prior to the insertion of the grip ring into the shell body.

Referring first to FIG. 1, the subject connector plug 10 for terminating semirigid coaxial cable is shown to comprise an elongate coupling nut 12, a tubular shell body 14, a gasket ring 16, and a grip ring 18. The subject connector plug is intended to terminate a semirigid coaxial cable 20, of the type comprising a center conductor 22, an intermediate dielectric layer 24, and an outer metallic solid sheath 26. The outer sheath 26 is commonly made of copper or like conductive metal. As shown, the center conductor 22 of the coaxial cable 20 is prepared to project forward a distance from the intermediate dielectric layer 24 and the metallic sheath 26 therearound. The tubular shell body 14, as illustrated in FIGS. 1 and 2, has a rearward portion 28, an annular flange 30 intermediately provided therearound, and a forward portion 32. A bore 34 extends longitudinally through the shell body 14, and a plurality of grooves 36 are provided within the interior walls of the rearward portion 28 defining the serrated bore 34. As best shown by FIG. 2, the interior of the shell body 14 is contoured forwardly from the rearward portion 28 towards the forward portion 32 as indicated by reference numeral 38. The purpose for this forward contour will be explained in greater detail below.

Continuing, the coupling nut 12 is internally threaded as indicated at 40, and further includes an inwardly projecting annular lip 42. The grip ring 18, as shown in FIG. 1, includes a solid body portion 44, multiple spline fingers 48 projecting forwardly from the periphery of the solid body portion 44, and an outwardly directed annular flange 46 at the rearward end of the solid body portion 44.

Figure 3A:
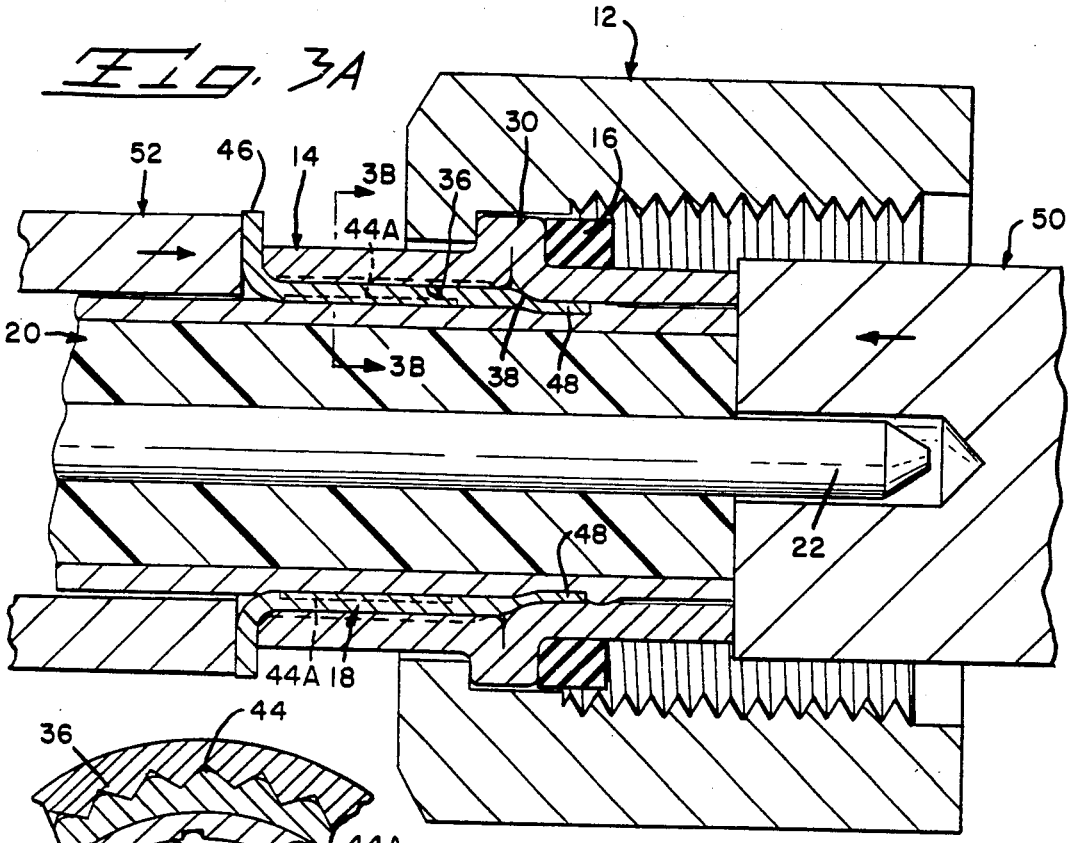
FIG. 3A is a side elevation view, taken partially in section, of the subject connector plug subsequent to full insertion of the grip ring into the shell body completing the termination to the coaxial cable.

Assembly of the subject connector procedes as follows. Referring to FIG. 2, the gasket ring 16 is first assembled over and against the annular flange 30 of the shell body 14. The coupling nut 12 is positioned having the annular lip 42 in engagement against the rearward side of the shell body annular flange 30, and projects forwardly therefrom. The grip ring 18 is slideably moved forward into the rearward end of the shell body 14, and there awaits the application of the termination tooling. As illustrated in FIG. 3A, the assembly tool has two opposing members 50, 52 which move relative to each other on a common axis. With the grip ring 18, coupling nut 12, and the shell body 14 preassembled over the cable as set forth above, the forward surface of the tool member 50 locates the end of the connector shell body 14 flush with the end of the cable sheath 26. The forwardmost extending surface of the other tool member 52 then presses the grip ring 18 into the shell body 14 until the flange 46 of the grip ring 18 is disposed adjacent the outer end of shell body 14. The coupling nut 12 is trapped between the grip ring flange 46 and the shell body flange 30.

With continuing reference to FIG. 3A, some general comments on the action of the grip ring 18 follow. As the spline fingers 48 enter the shell body 14, they are deflected inward by contour 38 of the shell body 14. The spline fingers 48 are forced into the softer cable sheath 26, plowing progressively deeper furrows with the forward motion. The spline fingers are sharp pointed for easy penetration and minimum distortion of the cable sheath 26. The self-splining action provides torque resistance and the tapered penetration resists tensile forces exerted upon the cable 20.

Figure 3B:
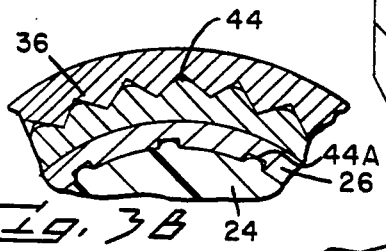
FIG. 3B is a view in transverse section of the connector plug illustrated in FIG. 3A, taken along the line 3B.

Referring to FIG. 3B, it will be appreciated that interaction between grip ring solid surface 44 and the longitudinal grooves 36 of the wall body 14 along with the interaction between grooves 44A on the inside surface of grip ring 18 and the cable sheath creates an interlocking relationship. This interlocking engagement further acts to resist any externally originating torque generated on the cable. Further, the interlocking press fit between the grooves 36 and surface 44 resists tensile forces between the grip ring 18 and the shell body 14 in the assembled state.

Figure 4:
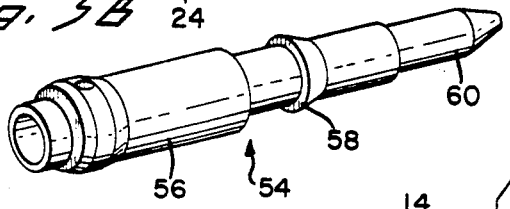
FIG. 4 is a perspective view of a contact member suitable for incorporation into an alternative embodiment of the subject invention.
Figure 5:
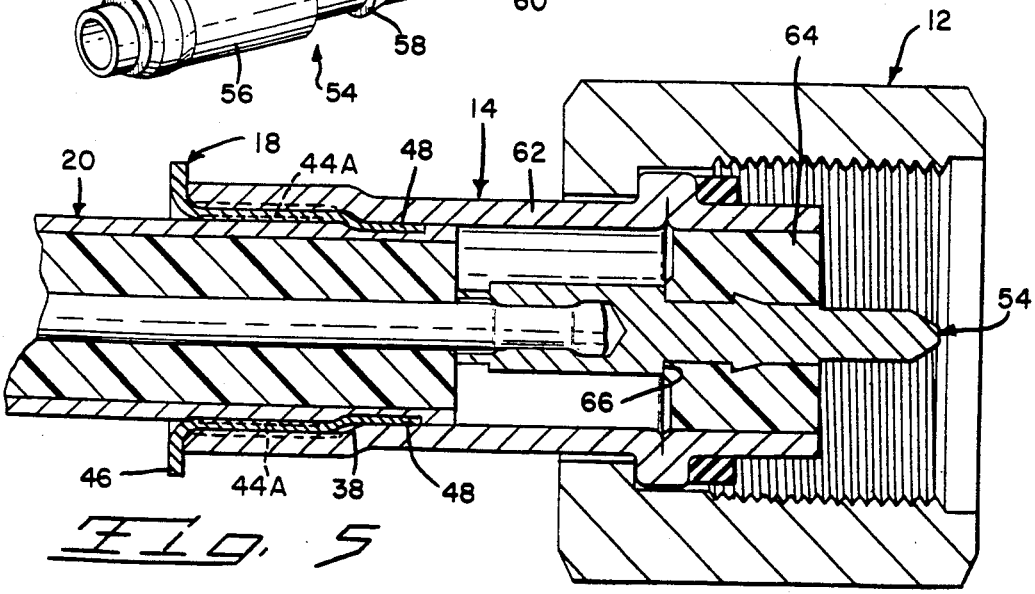
FIG. 5 is a side elevation view taken partially in section of a connector plug alternatively embodying the principles of the subject invention.

The subject invention is applicable to other connector configurations, such as cable jacks, and to other cable plug embodiments. One such other cable plug embodiment is illustrated in assembled transverse section by FIG. 5, and incorporates the use of a contact member 54 illustrated in FIG. 4. Referring to FIG. 4, the contact member 54 comprises a rearward crimp barrel 56, an intermediate annular latching projection 58, and a forward pin portion 60. As shown in FIG. 5, the contact member 54 is intended for engagement to the forwardly extending center conductor 22 of the semirigid cable 20, with the rearward crimp barrel 56 of the contact member 54 crimped to the center conductor 22 in a manner conventional to the industry. It will be further appreciated from FIG. 5 that the alternative embodiment of the subject invention includes a tubular shell body 14 having an elongated mid-portion 62. Further comprising the plug assembly shown in FIG. 5 is a dielectric insert body 64 intended for insertion into the forward end of the shell body 14, said insert 64 receiving the mid-portion of the contact member 54 therein. The annular latching projection 58 of the contact member 54 engages the dielectric insert 64 to retain the contact member therein, and a rearwardly extending shoulder 66 of the dielectric insert 64 abuts against the rearward crimp barrel portion 56 of the contact member. Assembly of the alternative plug embodiment in FIG. 5 procedes in the manner explained above for the preferred embodiment, with the grip ring 18 moved forward into the rearward portion of the shell body 14, and with the spline fingers 48 of the grip ring 18 deflected inwardly to embed into the outer metallic sheath 26 of the cable 20 and the serrated bore 34 and grooves 44A interacting respectively with grip ring 18 and the cable sheath. It will be appreciated that the contact member 54 projects through the elongate mid-portion 62 of the shell body 14 and, therein, is surrounded by free space.

Figure 6:
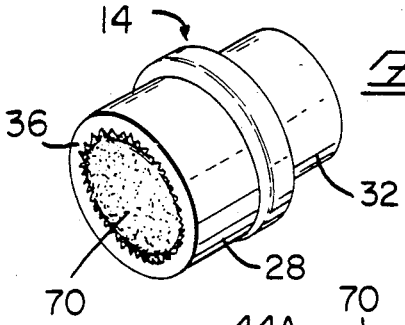
FIG. 6 is a perspective view showing a chemical adhesive disposed along the internal serrated surface of the shell body.
Figure 7:
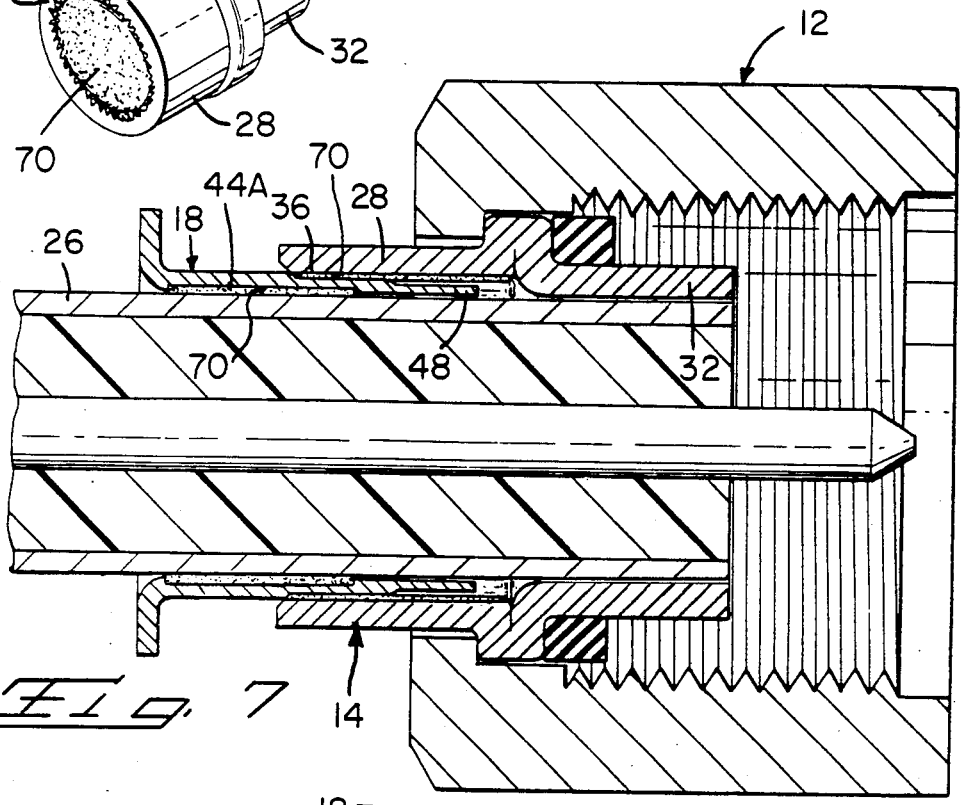
FIGS. 7 and 8 are cross-sectional views of a further alternative embodiment of the connector plug before and after the insertion of the grip ring into the shell body utilizing the chemical adhesive.
Figure 8:
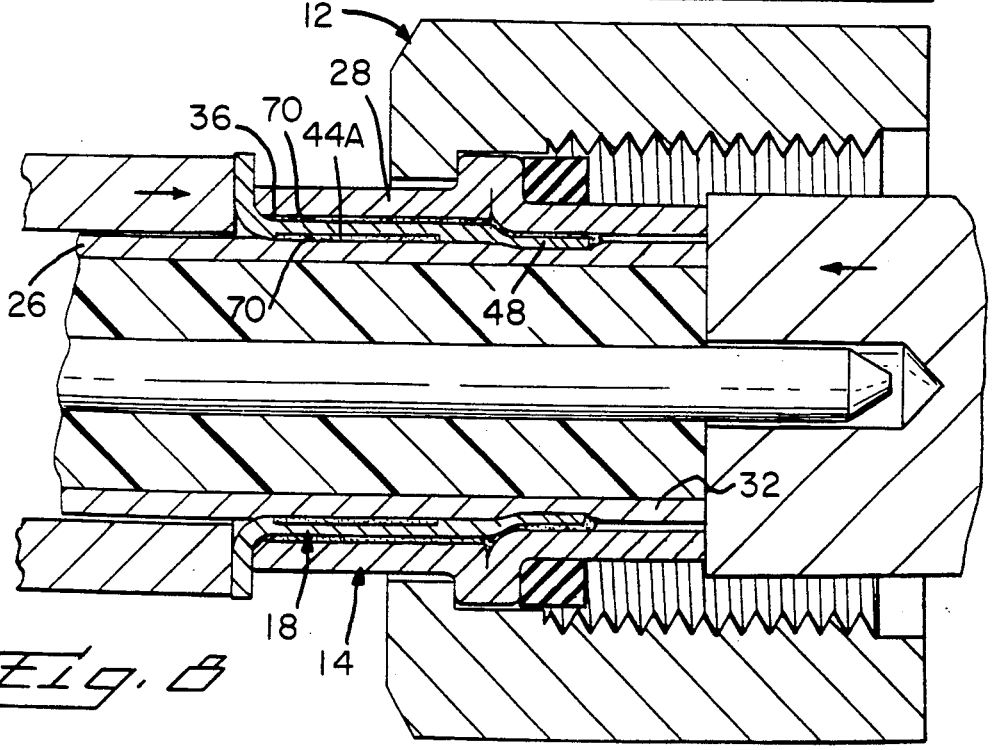

FIGS. 6 through 8 illustrate a further alternative embodiment of the connector plug. A chemical adhesive 70 is applied onto the internal surface of bore 34 of shell body 14 along the rearward portion 28 containing grooves 36. Chemical adhesive 70 is an anaerobic resin of methacrylate ester that is commercially available from the Loctite Corporation, Newington, Conn.; it is dry to the touch and remains inert until the forces of assembly releases the anaerobic resin from its protective film.

When grip ring 18 is moved into shell body 14 as previously described, shearing action is applied to adhesive 70 as section 44 of grip ring 18 moves along serrated section 36 of bore 34 of shell body 14; this causes rupture of the film containing the adhesive promoting flow thereof and providing lubrication to ease the movement of grip ring 18 along shell body 14. The adhesive fills the voids between serrated section 36 and the outer surface of section 44 when they are completely interengaged as shown in FIG. 8, and the adhesive is carried into the contoured area 38 and along the internal surface of forward portion 32 of shell body 14 as spline fingers 48 move therealong as they are deflected into and plow into the outer metal sheath 26 of coaxial cable 20. Thus, adhesive 70 extends along the engaging surfaces of grip ring 18 and shell body 14 and is disposed between fingers 48 in engagement with sheath 26 therebetween. After adhesive 70 cures, a liquid and gas seal is effected and the torque and tensile resistance of the connection is increased. Thus, no corrosion of the connection takes place.

Chemical adhesive 70 can also be disposed along the internal surface of grip ring 18 containing grooves 44A which will form a seal between such internal surface and outer metal sheath 26 of coaxial cable 20 when grip ring 18 is disposed within shell body 14. This will also increase tensile and torque of the connection.

In order to effect an optimum electrical and mechanical sealed connection when using adhesive 70, just enough adhesive is applied to serrated section 36 and/or grooved surface 44A without affecting the electrical characteristics of the connection.

While the above description of the preferred embodiment and the alternative embodiments exemplify principles of the subject invention, other embodiments which will be apparent to one skilled in the art and which utilize the teachings herein set forth are intended to be within the scope and spirit of the subject invention.

I claim:

1. An electrical connector for terminating semirigid coaxial cable, comprising:

a bored tubular shell member having rearward bore means of relatively large inner diameter inwardly contoured toward forward bore means having a relatively smaller inner diameter dimensioned to receive the cable therethrough;

an adhesive is applied onto said rearward bore means and is disposed within a protective film;

coupling means on said tubular member;

bored gripping means having a rearward collar portion dimensioned to closely receive the cable therethrough, and having a plurality of spline fingers extending forward from the periphery of said collar portion defining therebetween a profiled opening of a dimension substantially equal to the cable diameter, said gripping means being rearwardly disposed of said tubular member, whereby, upon moving said gripping means forwardly into said rearward bore means, said spline fingers are resiliently deflected inwardly along said contour to embed into an outer conductive layer of the cable and said protective film is ruptured causing said adhesive to flow between engaging surfaces of said shell member and said gripping means whereby when the adhesive cures, the adhesive seals the connection thereby increasing the torque and tensile resistance thereof.

2. A connector as set forth in claim 1, further comprising gasket means in peripheral engagement with said tubular shell member for sealing the interface of said connector.

3. A connector as set forth in claim 1, said tubular shell member having an outwardly directed external annular flange, and said coupling means comprising a nut having rearward flange means in engagement against said shell member flange.

4. A connector as set forth in claim 1, said center contact means comprising a forward length of the cable center conductor adapted to project forward a distance free of the outer conductive layer, and free of an intermediate dielectric layer of the cable disposed between the outer layer and the center conductor.

5. A connector as set forth in claim 1, said spline fingers each being tapered to a point.

6. A connector as set forth in claim 1, said tubular shell member having longitudinal grooves within rearward walls defining said rearward bore means, said grooves engaging said gripping means collar portion for resisting rotational motion of said gripping means within said tubular shell member.

7. A connector as set forth in claim 1, said gripping means having an outwardly directed annular flange at a rearward end adjacent a rearward end of said tubular shell member.

8. A connector as set forth in claim 1, wherein an inside surface of said gripping means includes grooves which engage the outer conductive cable layer when the gripping means is moved into the shell member.

9. A connector as set forth in claim 8, wherein said inside surface has said adhesive applied thereto so that said adhesive is disposed between said inside surface and the outer conductive layer of the cable.

10. A connector as set forth in claim 1, said center contact means comprising a terminal member affixed to a forward end of the cable center conductor.

11. A connector as set forth in claim 10, further comprising a dielectric insert having a bore therethrough, said forward bore means receiving said insert therein with said terminal member positioned within said insert bore.

12. An electrical connector for terminating semirigid coaxial cable, comprising:

a bored tubular shell member having rearward bore means of relative large inner diameter inwardly contoured toward forward bore means having a relatively smaller inner diameter dimensioned to receive the cable therethrough, and said shell member having longitudinally grooved wall means defining said rearward bore means;

an adhesive is applied onto said grooved wall means and is disposed within a protective film;

coupling means on said tubular member;

bored gripping means having a rearward collar portion dimensioned to closely receive the cable therethrough and having an outwardly directed annular flange at a rearward end, and said gripping means having a plurality of tapered spline fingers extending forward from the periphery of said collar portion defining therebetween a profiled opening of a dimension substantially equal to the cable diameter, said gripping means being rearwardly disposed of said tubular member, whereby, upon moving said gripping means forwardly into said rearward bore means with said gripping means flange disposed adjacent a rearward end of said tubular member, said spline fingers are resiliently deflected inwardly along said contour to embed into an outer conductive layer of the cable, said grooved wall means engaging said gripping means collar portion and said protective film is ruptured causing said adhesive to flow between engaging surfaces of said shell member and said gripping means whereby when the adhesive cures, the adhesive seals the connection thereby increasing the torque and tensile resistance thereof.

13. An electrical connector as set forth in claim 12, wherein grooves extend along an inner surface of said gripping means and engage the cable to resist rotational movement of the cable within said gripping means.

14. An electrical connector as set forth in claim 13, wherein said adhesive is disposed along said inner surface so that said adhesive is disposed between said inner surface and the outer conductive layer of the cable.

* * * * *